US008070540B2

(12) United States Patent
West et al.

(10) Patent No.: US 8,070,540 B2
(45) Date of Patent: Dec. 6, 2011

(54) METHOD AND KIT FOR ASSEMBLING MARINE PROPULSION SYSTEMS

(75) Inventors: Christopher Warren West, Clarksville, OH (US); Michael Joseph Boehm, Cincinnati, OH (US)

(73) Assignee: Sterndrive Engineering, Inc., Oldsmar, FL (US)

( * ) Notice: Subject to any disclaimer, the term of this patent is extended or adjusted under 35 U.S.C. 154(b) by 366 days.

(21) Appl. No.: 12/384,264

(22) Filed: Apr. 2, 2009

(65) Prior Publication Data

US 2009/0264030 A1 Oct. 22, 2009

Related U.S. Application Data

(60) Provisional application No. 61/046,907, filed on Apr. 22, 2008.

(51) Int. Cl.
*B63H 5/125* (2006.01)
*B63H 20/02* (2006.01)
*B63H 20/08* (2006.01)

(52) U.S. Cl. ..... 440/57

(58) Field of Classification Search ..... 440/53, 440/55–60, 75, 83, 111, 112
See application file for complete search history.

(56) References Cited

U.S. PATENT DOCUMENTS 5,755,604 A * 5/1998 Borgersen ..... 440/56
6,454,620 B1 * 9/2002 Theisen et al. ..... 440/61 R
6,468,119 B1 * 10/2002 Hasl et al. ..... 440/57
7,354,324 B1 * 4/2008 Jaszewski et al. ..... 440/57

* cited by examiner

*Primary Examiner* — Ajay Vasudeva
(74) *Attorney, Agent, or Firm* — Raul V. Fonte

(57) ABSTRACT

A method and a conversion kit are provided for assembling marine propulsion systems such as those comprised of a Mercruiser Alpha One® type sterndrive unit, an OMC Cobra® type inboard engine and a transom assembly, and attaching the propulsion systems to marine vessels. The method and the kit use commercially available parts and minimal special hardware. The technique involves a modified transom assembly comprised of an inner transom plate, a gimbal housing, a gimbal ring equipped with machined custom-made hinge pins, two trim cylinders with corresponding trim pins, and a bell housing with specially designed bellows and adaptor nipple. The invention is also applicable to the assembling of other marine propulsion systems that are comprised of equivalent combinations of similar sterndrive units attached to other similar inboard engines by means of transom assemblies.

12 Claims, 5 Drawing Sheets

METHOD AND KIT FOR ASSEMBLING MARINE PROPULSION SYSTEMS

This application is a non-provisional application for patent entitled to a filing date and claiming the benefit of earlier-filed Provisional Application for Patent No. 61/046,907, filed on Apr. 22, 2008 under 37 CFR 1.53 (c).

FIELD OF THE INVENTION

This invention relates to a method and kit for assembling marine propulsion systems and securing them to a marine vessel. Particularly, this invention relates to the assembling of marine propulsion systems that are comprised of certain types of outboard sterndrive units connected to certain types of inboard engines by means of transom assemblies that are also used to attach the propulsion systems to the vessels. More particularly, the invention relates to a method and kit for assembling Mercruiser Alpha-One-type sterndrive units and Outboard Marine Corporation ("OMC") Cobra-type inboard engines and attaching them to a marine vessel by means of transom assemblies. Specifically, the invention relates to a novel technique for adapting Mercruiser Alpha-One-type sterndrive units to OMC Cobra-type inboard engines and transom assemblies using commercially available parts and minimal special hardware. The invention is also further applicable to the assembling of other marine propulsion systems that are comprised of similar combinations of other outboard sterndrive units attached to other similar inboard engines by means of transom assemblies.

BACKGROUND OF THE INVENTION

Inboard-outboard marine propulsion systems, sometimes also referred to as "marine engine packages", or "I/O propulsion systems", are well-known in the marine vessel industry. These systems usually consist of an inboard component that includes an internal combustion engine and related hardware, an outboard component often enclosed in a casing with conventional hardware, and a transom assembly that serves the purpose of connecting the inboard component to the outboard component and securing the propulsion system to the vessel. The inboard component and the outboard component are connected to each other by a series of bolts, nuts, pins and other hardware that allow the transmission of power from the inboard component to the outdrive. Additional hardware is provided to secure the propulsion system to the transom of the vessel. Among these inboard-outboard marine propulsion systems, those manufactured by Outboard Marine Corporation ("OMC") have been used for years in the industry due to their durability and reliability, and many boats and other marine vessels are equipped with these types of systems. OMC inboard-outboard marine propulsion systems are no longer manufactured by OMC, even though their inboard engine components continue to be available as used parts and aftermarket equipment. In addition, inboard engine components of the type made by Volvo Penta and similar manufacturers continue to be available, new, used and as aftermarket equipment. Hardware to secure propulsion systems to the transom of boats and other marine vessels exist which usually consist of various arrangements of support plates, gimbal rings, bell housings, gimbal housings and other such parts. For example, U.S. Pat. Nos. 4,872,531 and 5,238,433 disclose the use of such types of hardware arrangements in conjunction with marine sterndrive units and inboard engines of watercraft inboard-outboard propulsion systems. The hardware arrangements described in these patents, however, have their limitations and are not suitable for adapting Mercruiser Alpha-One-type sterndrive units to OMC Cobra-type inboard engines and transom assemblies using commercially available parts and minimal special hardware.

It is apparent that a need exists for a technique whereby Mercruiser Alpha-One-type sterndrive units may be adapted to OMC Cobra-type inboard engines and transom assemblies using commercially available parts and minimal special hardware. The present invention is directed toward providing such a technique.

It is an object of the present invention to provide a method and a kit for the proper and safe assembling of inboard-outboard marine propulsion systems. It is a specific object of the present invention to provide a method and a kit for assembling Mercruiser Alpha-One-type sterndrive units and OMC Cobra-type inboard engines and attaching them to a marine vessel by means of transom assemblies. It is also an object of the present invention to provide a method and a conversion kit for adapting Mercruiser Alpha-One-type sterndrive units to OMC Cobra-type inboard engines and transom assemblies using commercially available parts and minimal special hardware. Another object of this invention is to provide a commercially practicable method and system for the proper and safe assembling of inboard-outboard marine propulsion systems while utilizing conventional components in a novel fashion in a safe and cost-effective manner. These and other objects of the invention will be apparent to those skilled in the art from the description that follows.

SUMMARY OF THE INVENTION

The method and the system of this invention center around the innovative concept of providing a modified transom assembly design, as well as a method for its use and installation. The invention allows the use of Mercruiser Alpha-One-type sterndrive units on marine vessels originally equipped with OMC Cobra-type inboard engines and does not require the replacement of the OMC transom assembly. Conventional hardware is used in assembling the propulsion system Is and securing it to the vessel. The modified transom assembly system of the invention is sometimes referred to as the "Mercruiser® Alpha®-One Conversion Kit" or, simply, as the "Mercruiser® Conversion Kit". Mercruiser and Alpha are believed to be registered marks of the Brunswick Corporation. The invention is also further applicable to the assembling of other marine propulsion systems that are comprised of equivalent combinations of other similar sterndrive units attached to other similar inboard engines by means of transom assemblies.

The modified transom assembly design of the invention involves the following components:

(a) An inner transom plate comprised of an inner transom support plate (made of aluminum or some other strong and corrosion-resistant metal or material), equipped with means for connecting an inboard engine on one side and means for attaching a gimbal housing on its other side. The means for connecting an inboard engine on one side include two or more inner transom plate through holes drilled on protruding members of the support plate and companion inner transom plate threaded bolts and nuts, or similar suitable hardware. The means for attaching the gimbal housing to the other side of the support plate are preferably six through holes adapted to receive threaded studs, or similar suitable hardware.

(b) A gimbal housing comprised of a gimbal housing casting with means for attaching the inner transom plate to its back (mounting) surface and means for connecting to its opposite surface a gimbal ring and the bellows from the bell housing. The means for attaching the inner transom plate to its back surface preferably include six gimbal housing threaded studs and matching nuts. The means for connecting a gimbal ring to its opposite surface preferably comprise symmetrically-located upper and lower gimbal housing through holes adapted to receive retaining pins ("gimbal housing swivel pins"). The means for connecting the bell housing bellows to its opposite surface include at least one pipe-shaped casting, flanged at one end (the "gimbal housing flanged casting"), and adapted to receive a gimbal bearing inside it, and the bell housing bellows on its outside. A clamp and an optional seal are used to secure the parts in place.

(c) A gimbal ring comprised of a gimbal ring casting made of aluminum (or some other strong and corrosion-resistant metal or material), having a substantially oval overall shape, and provided with a gimbal ring support base at the bottom and several symmetrically-located openings, or "through holes". A first pair of gimbal ring through holes on the side brackets of the casting is adapted to receive two machine-made hinge pins that allow the bell housing to oscillate up and down. A second pair of gimbal ring through holes are provided on the side brackets, below the first pair and located near the support base of the gimbal ring. This second pair of through holes serves to receive the hydraulic cylinder trim pin described below. A third pair of gimbal ring through holes on the casting support base and the casting top bracket, respectively, align themselves with the upper and lower through holes of the gimbal housing so that gimbal housing swivel pins may be placed in the through holes to secure the gimbal ring to the gimbal housing. The gimbal ring is also provided with two or more spacers, made of strong plastic or similar material, that are attachable to the inner portion of the "ears" of the gimbal ring. The gimbal ring may also include a steering arm or similar means for steering the marine vessel.

(d) Two trim cylinders and trim pins. The trim cylinders are hydraulic cylinders. The first trim pin penetrates the gimbal ring through holes located near the support base of the gimbal ring and is used to secure two ends of the trim cylinders to the gimbal ring. The second trim pin, on a parallel plane with the first trim pin, is connected to the other ends of the trim cylinders and serves to secure the other ends to the sterndrive. Suitable hardware should also be included.

(e) A bell housing that comprises a bell housing casting (made of aluminum or some other strong and corrosion-resistant metal or material), sized and shaped to fit inside the gimbal ring and provided with symmetrically-located bell housing through holes that align themselves with through holes in the gimbal ring and allow the bell housing to be secured to the gimbal ring by means of hinge pins. The bell housing also includes the custom-made bell housing u-joint bellows, the bell housing flanges, the bell housing clamps, the bell housing first water hose, the bell housing second water hose, and a bell housing adaptor nipple.

The method of the invention may be conveniently described with reference to a particularly preferred embodiment and application, that is, the mating of a Mercruiser Alpha-One-type sterndrive to an OMC Cobra-type inboard engine. It should be understood, however, that the method has applications in the proper assembling of other equivalent combinations of similar sterndrive units attached to other inboard engines by means of transom assemblies. In this preferred embodiment, the method of the invention comprises: (a) mating the inner diameter of the gimbal housing end of the Mercruiser Alpha-One-type sterndrive unit's u-joint rubber bellows to the gimbal housing flange of OMC Cobra-type engine's transom assembly by means of a u-joint bellows clamp; (b) attaching the bell housing of the Mercruiser Alpha-One-type sterndrive unit to the OMC Cobra-type engine's transom assembly's gimbal ring by means of two custom-made hinge pins that are specifically threaded to match the bell housing threaded holes on the Mercruiser Alpha-One-type sterndrive unit, said two custom-made hinge pins also having smooth bearing surfaces that match the inner diameters of the gimbal ring through holes; (c) attaching the Mercruiser Alpha-One-type sterndrive unit's seawater pump output hose (bell housing first water hose) to the seawater pump output hose (bell housing second water hose) of the OMC Cobra-type engine's transom assembly by means of a bell housing adaptor nipple that increases the effective diameter (ID) of the Mercruiser Alpha-type sterndrive unit's seawater pump output hose (bell housing first water hose) to match the effective diameter (ID) of the seawater pump output hose (bell housing second water hose) of the OMC Cobra-type engine's transom assembly; and (d) modifying (cut or filed to fit) the Mercruiser Alpha-One-type sterndrive unit's stops, as needed, to limit the amount of negative trim, and/or to trim down the bow of the marine vessel and optimize the ability to raise and lower the bow of the vessel. Bushings made of fiber or some other suitable material may be inserted and pressed into the gimbal ring through holes in order to minimize wear on the OMC Cobra-type engine's transom assembly's gimbal ring. The modified transom assembly may also be provided with two or more spacer guides, made of strong plastic or similar material, that are attachable to the inner portion of the "ears" of the gimbal ring.

BRIEF DESCRIPTION OF THE DRAWINGS

A clear understanding of the key features of the invention summarized above may be had by reference to the appended drawings. Accordingly:

FIG. 1*a* shows the inner transom plate, the gimbal housing and the gimbal ring components of the invention with their related hardware; and FIG. 1*b* shows the bell housing component of the invention and its related hardware.

DETAILED DESCRIPTION OF THE INVENTION

Figure 1A:
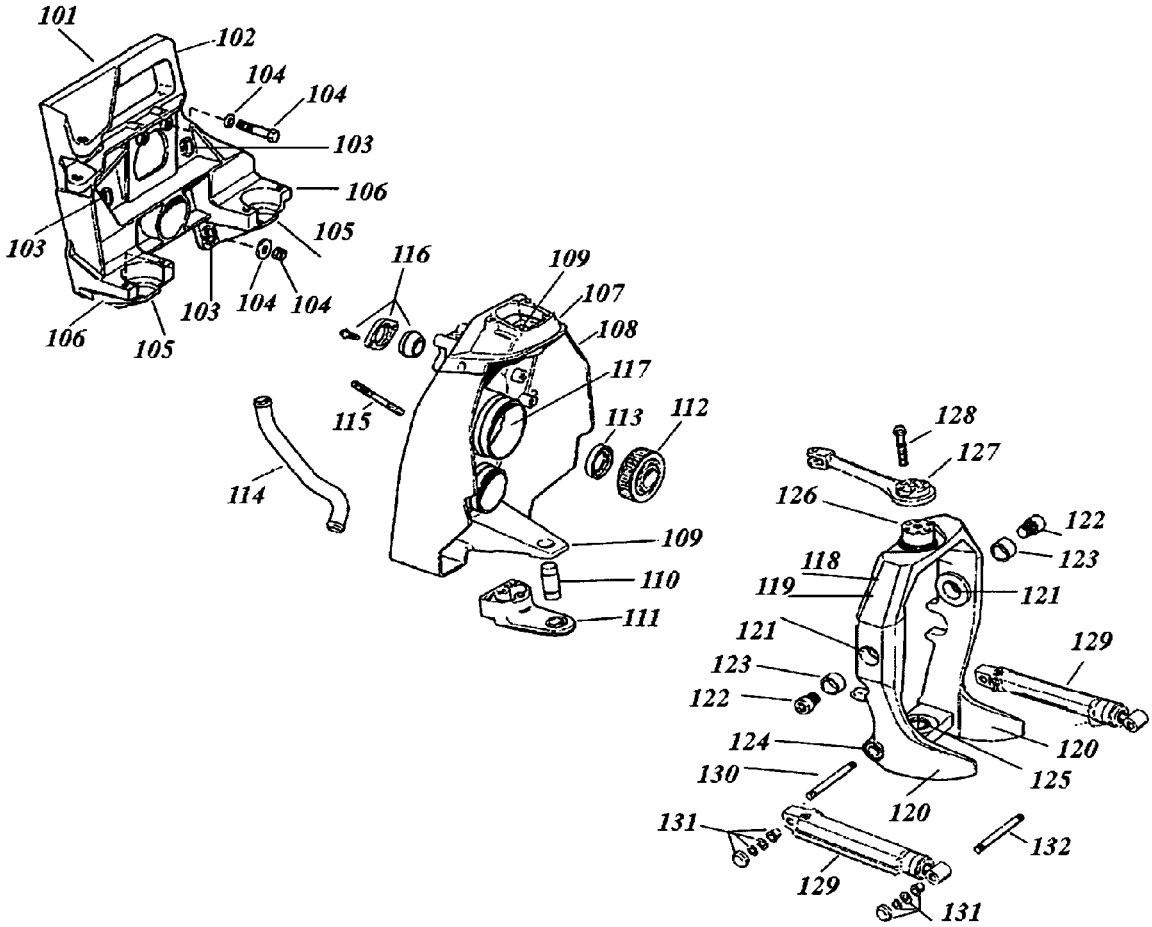
FIG. 1*a* and FIG. 1*b* illustrate the modified transom assembly of the invention showing all of its components.
Figure 1B:
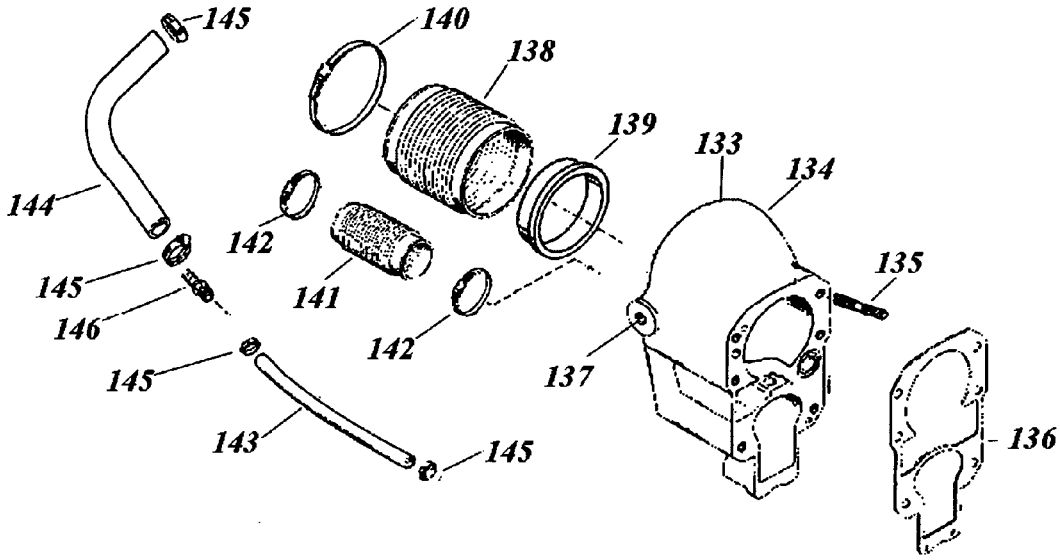

The various components of the modified transom assembly of the invention are shown in FIG. 1*a* and FIG. 1*b*. Accordingly, referring to FIG. 1*a* and FIG. 1*b*, inner transom plate 101 is comprised of inner transom support plate 102, which is a casting made of aluminum or some other strong and corrosion-resistant metal or material and equipped with means for connecting an inboard engine on one side and means for attaching a gimbal housing on its other side. The inner transom plate is normally placed inside the vessel. (So that its various parts are easily discernible, the inner transom plate is shown, in FIG. 1*a*, oriented 180 degrees from the direction in which it normally faces the gimbal housing.) The means for connecting an inboard engine on one side include two or more inner transom plate through holes 105 drilled on protruding members 106 of support plate 102 and companion inner transom plate threaded bolts and nuts (not shown). The means for attaching the gimbal housing to the other side of support plate 102 are preferably six through holes 103 adapted to receive threaded studs or similar suitable hardware 104.

Gimbal housing 107 is comprised of gimbal housing casting 108, which is a casting made of aluminum or some other strong and corrosion-resistant metal or material and equipped with means for attaching inner transom plate 101 to its back (mounting) surface and with means for connecting to its opposite surface a gimbal ring and the bellows from the bell housing. The gimbal housing is normally placed outside the vessel. The means for attaching inner transom plate 101 to the back surface of gimbal housing casting 108 preferably include six or more gimbal housing threaded holes (not shown) and matching studs 115, as well related hardware 104. The means for connecting a gimbal ring to the opposite surface of gimbal housing casting 108 comprise symmetrically-located upper and lower gimbal housing through holes 109 adapted to receive upper and lower gimbal housing swivel pins 110, which are retaining pins. Removable casting 111 is used to conveniently retain lower gimbal housing swivel pin 110 in place. The upper gimbal housing through hole 109 can alternatively receive built-in swivel pin 126 as described below. The means for connecting the bell housing bellows to the opposite surface of the gimbal housing casting 108 include at least one gimbal housing flanged casting 117, which is a pipe-shaped casting, flanged at one end and adapted to receive the gimbal bearing 112 inside and the bell housing bellows on the outside. The gimbal housing flanged casting is sometimes referred to in this Specification as the "gimbal housing flange". A clamp (not shown) and an optional seal 113 are used to secure the parts in place. Gimbal housing water tube 114, described below, is also part of the gimbal housing.

Gimbal ring 118 is comprised of gimbal ring casting 119, which is a casting made of aluminum or some other strong and corrosion-resistant metal or material, having a substantially oval overall shape and provided with gimbal ring support base 120 at the bottom and several symmetrically-located openings, or "through holes". The gimbal ring allows the sterndrive to swing left and right. As shown in FIG. 1*a*, gimbal ring support base 120 includes two symmetrically-spaced ear-shaped portions that are sometimes referred to as the "ears" of the gimbal ring. A first pair of gimbal ring through holes 121 on the side brackets of the casting is adapted to receive two machine-made hinge pins 122 and (optional) companion hinge pin bushings 123 that allow the bell housing to oscillate up and down. A second pair of gimbal ring through holes 124 are provided on the side brackets, below the first pair and located near the support base of the gimbal ring. This second pair of through holes serves to receive the hydraulic cylinder trim pin described below. A third pair of gimbal ring through holes 125 on the casting support base and the casting top bracket, respectively, align themselves with the upper and lower gimbal housing through holes 109 so that gimbal housing swivel pins 110 may be placed in the through holes to secure the gimbal ring to the gimbal housing. In a preferred embodiment, built-in swivel pin 126 is used instead of a regular swivel pin 110 to secure the upper portion of the gimbal ring to the gimbal housing. The gimbal ring is also provided with two or more spacer guides, made of strong plastic or similar material, that are attachable to the inner portion of the "ears" of the gimbal ring. The gimbal ring may also include a steering arm or similar means for steering the marine vessel. In the illustration shown in FIG. 1*a*, steering lever 127 and lever retaining bolt 128 are used for that purpose.

The transom assembly also includes two trim cylinders and two trim pins. The two trim cylinders 129 are twin hydraulic cylinders shaped and sized to be mated to the trim pins. The first trim pin 130 is shaped and sized to penetrate and fit snuggly into second pair of gimbal ring through holes 124, located near the support base of the gimbal ring, and to mate to one end of the two trim cylinders. Suitable hardware 131, in the form of bushings, washers, clips, caps and the like, is used to connect the cylinders to the trim pins. The first trim pin 130 is used to secure two ends of trim cylinders 129 to the gimbal ring. The second trim pin 132, on a parallel plane with first trim pin 130, is connected to the other ends of trim cylinders 129 by suitable hardware 131 and serves to secure the other ends of trim cylinders 129 to the sterndrive.

The transom assembly also comprises a modified bell housing 133 that comprises a bell housing casting 134, which is a casting made of aluminum or some other strong and corrosion-resistant metal or material, and sized and shaped to fit inside the gimbal ring. Bell housing casting 134 is provided with symmetrically-located and threaded bell housing holes 137 that align with first pair of gimbal ring through holes 121 in the gimbal ring and allow the bell housing to be secured to the gimbal ring by means of machine-made hinge pins 122 and optional companion hinge pin bushings 123 so that the bell housing is able to oscillate up and down.

The bell housing 133, FIG. 1*b*, also includes the bell housing u-joint bellows 138, preferably made of rubber or rubber-like material, the bell housing flanges (not shown), which are similar to the flange of gimbal housing flanged casting 117), the bell housing gasket 136, the bell housing clamps 145, the bell housing first water hose 143, the bell housing second water hose 144, and the bell housing adaptor nipple 146. The bell housing attaches to the gimbal housing and allows the sterndrive to move up and down. Studs 135 and gasket 136 are used to attach the sterndrive (not shown) to bell housing casting 134. Bell housing u-joint bellows sleeve 139 is used to secure one end of bell housing u-joint bellows 138 to a flange located in bell housing 133; gimbal housing u-joint bellows clamp 140 is used to secure the other end of bell housing u-joint bellows 138 to gimbal housing flange 117. The bell housing u-joint bellows surround and protect a segment of the stemdrive shaft, usually the segment that comprises the u-joints of the shaft. Other bellows, such as bell housing exhaust bellows 141, and bell housing exhaust bellows clamps (worm gear clamps) 142 may be used, optionally, as exhaust conduits or engine exhaust tubes. Additional bellows and suitable flanges and clamps may also be used to shroud and protect cables and other mechanical parts.

The bell housing 133 further includes bell housing first water hose 143, bell housing second water hose 144, and bell housing adaptor nipple 146, as well as suitable clamps 145. Bell housing first water hose 143 is a hose made of rubber or rubber-like material, having a length of anywhere between about 3 and 8 inches, an inside diameter of approximately ¾ inch and an outside diameter of approximately $1^{1/8}$ inch. Bell housing first water hose 143 is connectable on one end to the bell housing water inlet (not shown) and on its other end to bell housing adaptor nipple 146. Bell housing second water hose 144 is a hose made of rubber or rubber-like material, having a length of anywhere between about 3 and 8 inches, an inside diameter of approximately 1 inch and an outside diameter of approximately $1^{5/16}$ inch. Bell housing second water hose 144 is connectable on one end to bell housing adaptor nipple 146 and on its other end to gimbal housing water tube 114. Suitable clamps 145 are used to make these connections. The gimbal housing water tube 114 is a molded plastic tube having a length of anywhere between about 6 and 12 inches, a variable-size inside diameter and an outside diameter of approximately 1 inch. Gimbal housing water tube 114 is attached to gimbal housing casting 108 by means of suitable hardware 116. The gimbal housing water tube is used to transfer water from the bell housing second water hose to the engine for engine cooling purposes. The bell housing first water hose is connected to the bell housing water inlet by means of a water inlet nipple (not shown). The bell housing water inlet is a cavity that receives seawater withdrawn from the sea by means of a cavity in the sterndrive. The bell housing water inlet is preferably cylindrical and runs the depth of the bell housing. The bell housing water inlet may be threaded at its backside (facing the gimbal housing) to best secure it to the water inlet nipple (if the water inlet nipple is also threaded). The water inlet nipple may also be glued, pressed or, if convenient, bolted to the bell housing, or it may even be part of the bell housing casting. Preferably, the water inlet nipple is made of plastic and pressed and glued to the bell housing casting on one end.

Bell housing first water hose 143 and bell housing second water hose 144 are connected to each other by means of bell housing adaptor nipple 146. Bell housing adaptor nipple 146 is a $2^{1/8}$-inch-long unthreaded pipe-shaped conduit provided with an opening at each end. The first opening is substantially round and has an outside diameter ("OD") of approximately ¾ inch and an inside diameter ("ID") of approximately ½ inch. The second opening is substantially round and has an outside diameter of approximately 1 inch and an inside diameter of approximately ¾ inch. Worm gear clamps or similar clamping devices are used on both ends of bell housing adaptor nipple 146 in order to secure first water hose 143 and second water hose 144 to it. Bell housing adaptor nipple 146 is preferably made of a strong plastic. The adaptor nipple may also be made of stainless steel, brass or some other metal.

Figure 2:
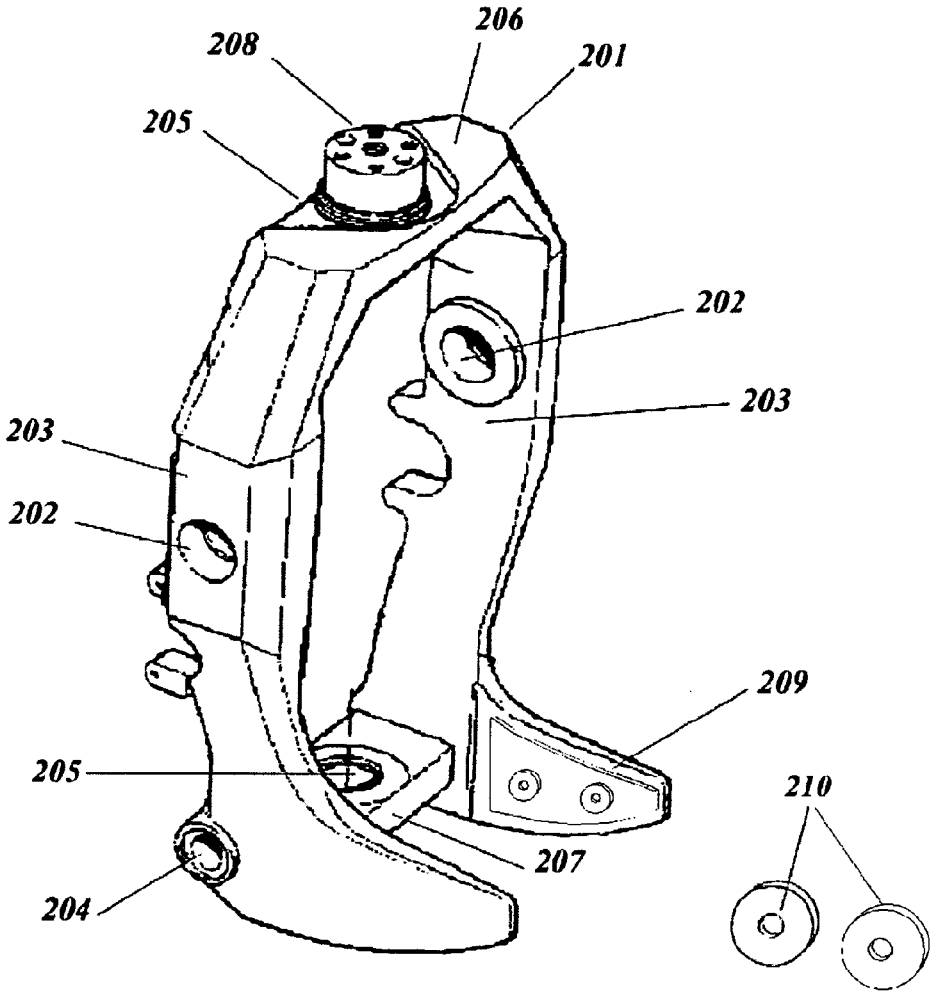
FIG. 2 is a diagram of the gimbal ring component and the spacer guides of the modified transom assembly of the invention.

The gimbal ring component and the spacer guides of the modified transom assembly design of the invention are illustrated in FIG. 2, where gimbal ring 201 is shown with first pair of gimbal ring through holes 202 drilled through gimbal ring side brackets 203, second pair of gimbal ring through holes 204, drilled through the lower portions of side brackets 203, and third pair of gimbal ring through holes 205 drilled through the upper and lower supporting brackets 206 and 207, respectively. Built-in swivel pin 208 fits in upper through hole 205 and functions as a swivel pin to secure the upper portion of the gimbal ring to the gimbal housing. The first pair of gimbal ring through holes 202 is not threaded; the holes are aligned with each other on the same plane; and each of their inner diameters is adapted to receive the smooth-bearing outer surface of the custom-made hinge pin, depicted in FIG. 4, below. The second pair of through holes 204 serves to receive the hydraulic cylinder trim pin, as already described. The third pair of gimbal ring through holes 205 on the casting support base and the casting top bracket, respectively, align themselves with the upper and lower gimbal housing through holes so that gimbal housing swivel pins may be placed in the through holes to secure the gimbal ring to the gimbal housing. Spacer guides 209 may be round, square, triangular or of any other convenient shape. They may also mimic the shape of the "ears" of the gimbal ring as shown in FIG. 2. The spacer guides should be made of strong plastic or similar minimum-wear material and have a minimum thickness of approximately ½ inch and a maximum thickness of approximately ¾ inch. They may be bolted, glued or otherwise attached to the "ears" of the gimbal ring or, alternatively, they may be bolted, glued or otherwise attached to the sides of the sterndrive. In one preferred embodiment the spacer guides are ½-inch-thick round plastic ring-shaped pads 210, capable of being bolted to the sides of the sterndrive.

Figure 3:
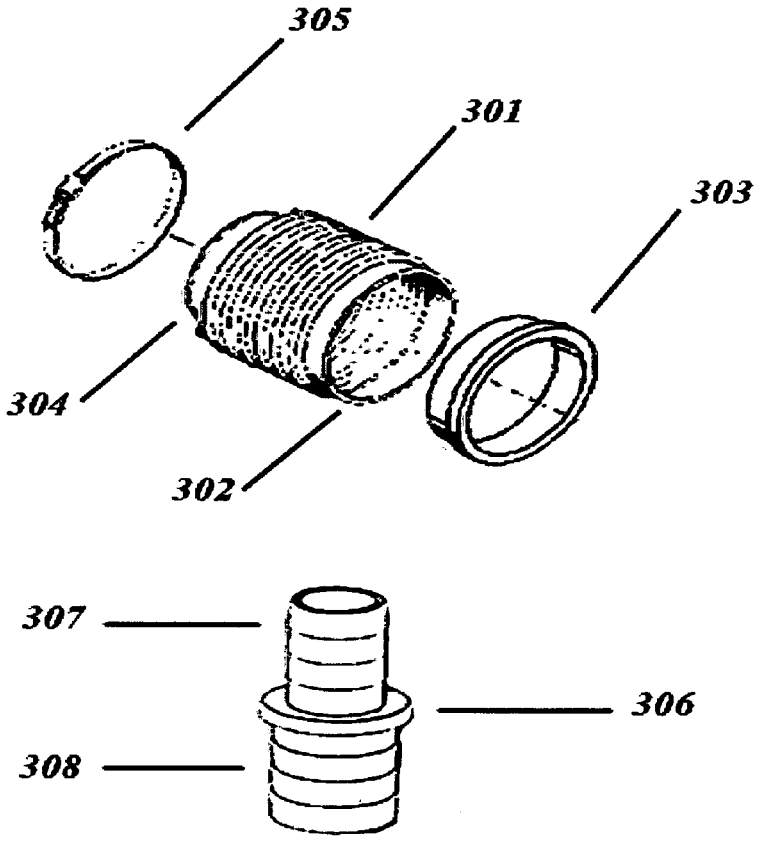
FIG. 3 is a diagram of the bell housing component of the modified transom assembly of the invention, showing the custom-made bell housing u-joint bellows and the bell housing adaptor nipple.

FIG. 3 is a diagram of two elements of the bell housing component of the modified transom assembly of the invention, showing the custom-made bell housing u-joint bellows 301 and the bell housing adaptor nipple 306. As illustrated in FIG. 3, custom-made accordion-shaped rubber bellows 301 are ridged on their outer surface and on their inner surface, except for the ends; their length is $5^{1/4}$ inches, and their outside diameter (OD), including the ridges, is 5½ inches. Their inside diameter (ID) is $3^{7/8}$ inches, except for the portion that comprises the gimbal housing end, which has an ID of 4 inches. Bell housing end 302 of rubber bellows 301 is sized to retain that end of the bellows and secure it to a flange (not shown) located in the bell housing. Thus, its length is approximately ½ inch, its inside diameter (ID) is $3^{7/8}$ inches, its major outside diameter, including the ridge, is $4^{3/8}$ inches, and its minor outside diameter is $4^{1/8}$ inches. Bell housing u-joint bellows sleeve 303 fits snuggly inside bell housing end 302 of rubber bellows 301 and is sized accordingly. Making and sizing the bell housing end 302 of rubber bellows 301 in this fashion, together with bellows sleeve 303, allows the assembler to connect the modified bell housing component of the invention to a Mercruiser Alpha-One-type sterndrive unit. Gimbal housing end 304 is sized to retain that end of the bellows and secure it to the gimbal housing flange casting (flange 117 in FIG. 1*a*). Thus, the length of gimbal housing end 304 is approximately ½ inch, its inside diameter (ID) is 4 inches, its major outside diameter, including the ridge, is $4^{3/8}$ inches, and its minor outside diameter is $4^{1/4}$ inches. Bell housing u-joint bellows clamp 305, used to conveniently secure gimbal housing end 304 of rubber bellows 301 to the gimbal housing flange, fits outside gimbal housing end 304 and is sized accordingly. Making and sizing the gimbal housing end 304 of rubber bellows 301 in this fashion, together with bellows clamp 305, allows the assembler to connect the modified bell housing component of the invention to an OMC Cobra-type inboard engine. Overall, gimbal housing end 304 has smaller outside and inside diameters than bell housing end 302. Neither end is ridged on its inside surface.

Bell housing adaptor nipple 306 is used to connect the bell housing first water hose to the bell housing second water hose. Preferably, bell housing adaptor nipple 306 is a $2^{1/8}$-inch-long unthreaded pipe-shaped conduit provided with an opening at each end. The first portion 307 of adaptor nipple 306 is about 1 inch long and substantially round. This portion 307, shown in FIG. 3 as the upper portion of the nipple, has an outside diameter ("OD") of approximately ¾ inch and an inside diameter ("ID") of approximately ½ inch. The second portion 308 is also substantially round, has an outside diameter of approximately 1 inch and an inside diameter of approximately ¾ inch. Portion 307 fits snuggly into one end of the first water hose, while portion 308 fits snuggly into one end of the second water hose. Worm gear clamps or similar clamping devices are used on both ends of bell housing adaptor nipple 306 in order to secure to it the first water hose and the second water hose. Bell housing adaptor nipple 306 may be made of stainless steel, brass or some other metal. Preferably, the adaptor nipple is made of a strong plastic.

Figure 4:
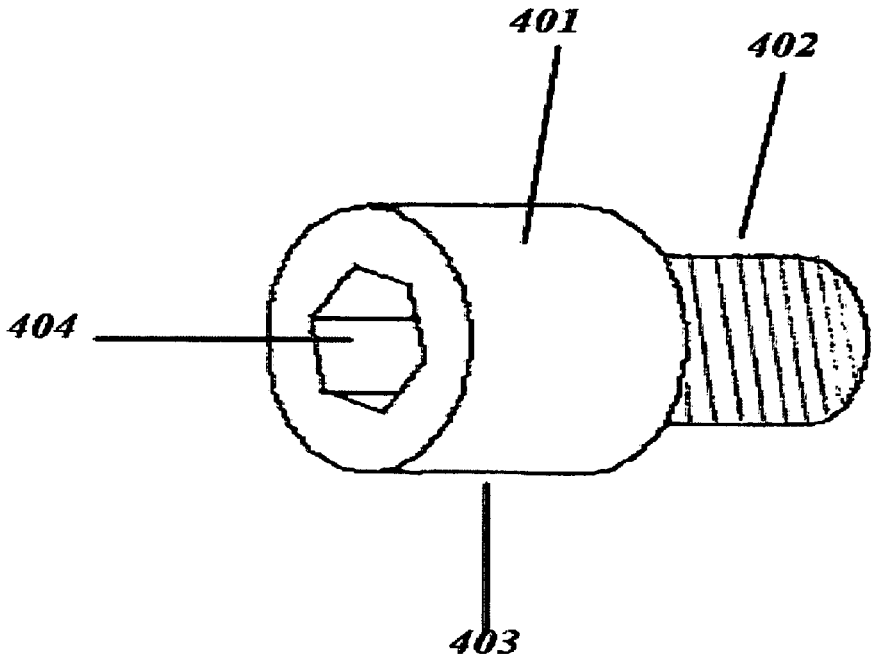
FIG. 4 is a diagram of one of the machine-made gimbal ring hinge pins of the invention.

As already described, the bell housing casting is provided with symmetrically-located and threaded bell housing holes that align with a first pair of gimbal ring through holes in the gimbal ring and allow the bell housing to be secured to the gimbal ring by means of two machine-made hinge pins, as well as optional companion hinge pin bushings, so that the bell housing is able to oscillate up and down. Each pin is machined to custom specifications. The kind of machine-made hinge pin used for this purpose is shown in FIG. 4 as hinge pin 401, having a first portion 402 comprising a ¾-inch-long solid cylinder, threaded on the outside to 18 threads-per-inch of length, and having a ⅝-inch outside diameter. Hinge pin 401 also has a second portion 403 comprising a ¾-inch-long solid cylinder, having a 1-inch outside diameter. The second portion 403 of pin 401 is not threaded. A socket indentation 404, shaped and sized to fit an Allen wrench, is provided at the base of second portion 403 for ease of installation. The machined custom-made hinge pins are made of stainless steel or other similarly strong and corrosion-resistant metal. The outside surface of first portion 402 of hinge pin 401 is threaded, as specified above, in order to match and fit inside the symmetrically-located and threaded bell housing holes (shown as holes 137 in FIG. 1*b*), while the outside surface of second portion 403 of hinge pin 401 is not threaded, but is machined to fit in smoothly in gimbal ring through holes on the side brackets of the gimbal ring casting (shown as through holes 121 in FIG. 1*a*). Making and using the two machined custom-made hinge pins in this fashion allows the assembler to properly secure the modified transom system's bell housing to the gimbal ring so that the bell housing may oscillate up and down and the propulsion system is able to operate properly.

The modified transom assembly of the invention may be used in conjunction with the method of the invention in order to assemble Mercruiser Alpha-One-type sterndrive units and OMC Cobra-type engines, and attach them to marine vessels. Accordingly, in reference to FIG. 1*a* and FIG. 1*b*, the method of the invention comprises: (a) mating the inner diameter of the gimbal housing end of the Mercruiser Alpha-One-type sterndrive unit's u-joint rubber bellows 138 to gimbal housing flange 117 of OMC Cobra-type engine's transom assembly by means of u-joint bellows clamp 140; (b) attaching the bell housing 133 of the Mercruiser Alpha-One-type sterndrive unit to the OMC Cobra-type engine's transom assembly's gimbal ring 118 by means of two machine-made hinge pins 122, threaded to match the bell housing threaded holes 137 on said Mercruiser Alpha-One-type sterndrive unit, said two hinge pins 122 having smooth bearing surfaces matching the inner diameters of gimbal ring through holes 121; (c) attaching the Mercruiser Alpha-One-type sterndrive unit's seawater pump output hose (bell housing first water hose 143) to the seawater pump output hose (bell housing second water hose 144) of the OMC Cobra-type engine's transom assembly by means of bell housing adaptor nipple 146, which increases the effective diameter (ID) of the Mercruiser Alpha-type sterndrive unit's seawater pump output hose (bell housing first water hose 143) to match the effective diameter (ID) of the seawater pump output hose (bell housing second water hose 144) of the OMC Cobra-type engine's transom assembly; and (d) modifying (cut, shaved or filed to fit) the Mercruiser Alpha-One-type sterndrive unit's stops, as needed, to limit the amount of negative trim, and/or to trim down the bow of the marine vessel and optimize the ability to raise and lower the bow of the vessel. The sterndrive stops are protrusions located on the upper portion of the housing of the sterndrive and designed to limit the degree of negative trim of the vessel. Optionally, fiber bushings 123 may be inserted and pressed into through holes 121 to minimize wear on the OMC Cobra-type engine's transom assembly's gimbal ring.

It will be understood that the appended figures depict preferred embodiments of the present invention and, therefore, are not to be considered as limiting its scope with regard to other embodiments which the invention is capable of contemplating. While the invention has been described in terms of particular embodiments and applications, in both summarized and detailed forms, it is not intended that these descriptions in any way limit its scope to any such embodiments and applications, and it will be understood that various substitutions, changes and variations in the described embodiments, applications and details of the method and system illustrated herein and of their operation can be made by those skilled in the art without departing from the spirit of this invention.

We claim:

1. A transom assembly kit for assembling marine propulsion systems comprising an inboard engine and a stern drive unit and securing them to a marine vessel, said transom assembly kit comprising:

(a) an inner transom plate comprised of an inner transom support plate having a first side and an opposing second side, said support plate provided with means for connecting said inboard engine on the first side of said support plate;

(b) a gimbal housing comprised of a gimbal housing casting provided with means for attaching said second side of said inner transom plate to a front surface of said gimbal housing casting, said gimbal housing casting comprising at least one pipe-shaped casting with a flange at one end and adapted to receive a bearing in its inside surface;

(c) a gimbal ring comprised of:

(i) a gimbal ring casting having a substantially oval shape, said gimbal ring casting comprising side brackets and a support base with protruding ears, said gimbal ring casting further comprising first and second pairs of gimbal ring through holes, each pair of gimbal ring through holes symmetrically located on said side brackets; and (ii) two machine-made hinge pins each having first and second portions, said first portion comprising a solid cylinder threaded on its outside surface and having an outside diameter and said second portion comprising a solid cylinder having an outside smooth surface and an outside diameter sized to match and fit smoothly within respective one of said first pair of gimbal ring through holes, wherein the size of said outside diameter of said first portion of each said machine-made hinge pin is approximately ⅝inch, and the size of said outside diameter of said second portion of each said machine-made hinge pin is approximately 1 inch;

(d) a first trim pin, a second trim pin and two hydraulic trim cylinders, said first trim pin being connectable to both first ends of said two hydraulic trim cylinders and to said second pair of the gimbal ring through holes, and said second trim pin being connectable to both second ends of said two hydraulic trim cylinders and serving to secure said hydraulic trim cylinders to said stern drive unit;

(e) a bell housing comprised of:

(i) a bell housing casting, sized and shaped to fit inside said gimbal ring and provided with symmetrically located bell housing holes adapted to be aligned with said first pair of gimbal ring through holes, said bell housing holes being threaded and sized to receive said first portion of said hinge pins to allow the bell housing to be secured to the gimbal ring for up and down movement with respect to the gimbal ring;

(ii) bellows having a tubular shape configured to surround and protect a segment of a stern drive shaft, said bellows ridged on an outside surface and having a bell housing end and a gimbal housing end, said bell housing end sized for securing it to a flange located in said bell housing casting and connecting said bell housing to said stern drive unit; said gimbal housing end sized for securing it to said flange on said gimbal housing on its outside surface;

(iii) a bell housing first water hose, having an inside diameter and an outside diameter, and connectable on one end to a bell housing water inlet and on its other end to a bell housing adaptor nipple;

(iv) a bell housing second water hose, having an inside diameter and an outside diameter substantially different from said inside and outside diameters of said first water hose, said second water hose connectable on one end to said bell housing adaptor nipple and on its other end to a gimbal housing water tube that is attachable to said gimbal housing casting and used to transfer cooling water from said bell housing second water hose to said inboard engine; and (v) said bell housing adaptor nipple comprising an unthreaded pipe-shaped conduit provided with an opening at each end, the first of such openings sized to make a secure connection with one end of said first water hose, and the second of such openings sized to make a secure connection with said bell housing second water hose; and (f) at least two spacer guides attachable to inner surfaces of the ears of said gimbal ring or to corresponding outer surfaces of said stern drive unit, said spacer guides sized to tightly fit in the space between said inner surfaces of the ears and said outer surfaces of the stern drive unit to prevent or minimize the bell housing or the stern drive unit from moving relative to the gimbal ring, said two spacer guides having a minimum thickness of approximately ½inch and a maximum thickness of approximately ¾inch.

2. The transom assembly kit of claim 1, wherein said first portion of each said machine-made hinge pin of the gimbal ring is about ¾-inch long and threaded on its outside surface to 18 threads-per-inch of length, and said second portion of each said machine-made hinge pin is about ¾-inch long.

3. The transom assembly kit of claim 1, wherein the size of said bell housing first water hose inside diameter is approximately ¾inch, the size of said bell housing first water hose outside diameter is approximately $1^{1/18}$ inch, the size of said bell housing second water hose inside diameter is approximately 1 inch, and the size of said bell housing second water hose outside diameter is approximately $1^{5/16}$ inch.

4. The transom assembly kit of claim 1, wherein said bell housing end of said bell housing bellows has a non-ridged inside surface, a length of approximately ½inch, an inside diameter of $3^{7/8}$ inches, a major outside diameter, including the outside ridge, of $4^{3/8}$ inches, and a minor outside diameter of $4^{1/8}$ inches, and said gimbal housing end of said bell housing bellows has a non-ridged inside surface, a length of approximately ½inch, an inside diameter of 4 inches, a major outside diameter, including the outside ridge, of $4^{3/8}$ inches, and a minor outside diameter of $4^{1/4}$ inches.

5. The transom assembly kit of claim 1, wherein said bell housing bellows are custom-made accordion-shaped rubber bellows, ridged on their inner surface as well as on their outer surface, except for said bell housing end and said gimbal housing end, which are not ridged on either surface, and said bell housing bellows have a length of about $5^{1/14}$ inches, an outside diameter, including the ridges, of about 5½inches, and an inside diameter of $3^{7/8}$ inches, and wherein the portion of said bell housing bellows comprising said gimbal housing end has an inside diameter of 4 inches.

6. The transom assembly kit of claim 5, wherein said first opening at the end of said conduit comprising said bell housing adaptor nipple is round and has an outside diameter of approximately ¾inch and an inside diameter of approximately ½inch, and said second opening at the other end of said conduit is round and has an outside diameter of approximately 1 inch and an inside diameter of approximately ¾inch.

7. The transom assembly kit of claim 5, further comprising:

(i) at least one bell housing bellows clamp connectable to and sized to secure said gimbal housing end of said bell housing bellows to said gimbal housing flange; and (ii) at least one bell housing bellows sleeve connectable to and sized to secure said bell housing end of said bell housing bellows to said flange located in said bell housing casting.

8. A method for assembling a marine propulsion system and securing the propulsion system to a marine vessel, the method comprising:

(a) providing the transom assembly kit according to claim 1;

(b) mating the inner diameter of said gimbal housing end of said bell housing bellows to the outside surface of said gimbal housing flange by means of a bellows clamp;

(c) attaching said bell housing to said gimbal ring by means of said machine-made hinge pins;

(d) attaching said bell housing first water hose to said bell housing second water hose by means of said bell housing adaptor nipple to increase the effective diameter of said bell housing first water hose;

(e) securing said gimbal ring to said gimbal housing by means of gimbal housing swivel pins placed in upper and lower gimbal ring through holes aligned with corresponding upper and lower gimbal housing through holes;

(f) attaching said gimbal housing casting to said second side of the inner transom plate; and (g) attaching said spacer guides to the inner surfaces of the ears of said gimbal ring or to the outer surfaces of said stern drive unit to tightly fit in the space between said inner surfaces of the ears and said outer surfaces of the stern drive unit for preventing or minimizing the bell housing or the stern drive unit from moving relative to the gimbal ring.

9. The method according to claim 8, wherein said first portion of each said machine-made hinge pin of the gimbal ring of said transom assembly kit is about ¾-inch long and threaded on its outside surface to 18 threads-per-inch of length, and said second portion of each said machine-made hinge pin is about ¾-inch long.

10. The method according to claim 8, wherein the size of said transom assembly kit bell housing first water hose inside diameter is approximately ¾inch, the size of said bell housing first water hose outside diameter is approximately $1^{1/8}$ inch, the size of said bell housing second water hose inside diameter is approximately 1 inch, and the size of said bell housing second water hose outside diameter is approximately $1^{5/16}$ inch.

11. The method according to claim 8, wherein said first opening at the end of said conduit comprising said bell housing adaptor nipple of said transom assembly kit is round and has an outside diameter of approximately ¾inch and an inside diameter of approximately ½inch, and said second opening at the other end of said conduit is round and has an outside diameter of approximately 1 inch and an inside diameter of approximately ¾inch.

12. The method according to claim 8, further comprising modifying the stops of the stern drive unit in said marine propulsion system to limit the amount of negative trim, and/or to trim down the bow of said marine vessel and optimize the ability to raise and lower the bow of said vessel.

* * * * *